United States Patent [19]

Krieg

[11] 4,228,771

[45] Oct. 21, 1980

[54] LASH ADJUSTMENT MEANS FOR VALVE GEAR OF AN INTERNAL COMBUSTION ENGINE

[75] Inventor: John J. Krieg, Battle Creek, Mich.

[73] Assignee: Eaton Corporation, Cleveland, Ohio

[21] Appl. No.: 882,305

[22] Filed: Feb. 28, 1978

Related U.S. Application Data

[63] Continuation of Ser. No. 779,219, Mar. 18, 1977, abandoned, which is a continuation of Ser. No. 606,632, Aug. 21, 1975, abandoned, which is a continuation-in-part of Ser. No. 550,785, Feb. 18, 1975, abandoned.

[51] Int. Cl.[2] ..... F01L 1/24

[52] U.S. Cl. ..... 123/90.55; 123/90.35; 123/90.57

[58] Field of Search ..... 123/90.35, 90.55, 90.56, 123/90.57, 90.58, 90.59

[56] References Cited

U.S. PATENT DOCUMENTS

| | | | |
|---|---|---|---|
| 2,689,554 | 9/1954 | Moser | 123/90.55 |
| 2,784,706 | 3/1957 | Humphreys | 123/90.55 |
| 2,792,819 | 5/1957 | Moser | 123/90.55 |
| 2,941,523 | 6/1960 | Bergmann | 123/90.55 |
| 2,942,595 | 6/1960 | Bergmann | 123/90.55 |
| 2,943,613 | 7/1960 | Line | 123/90.55 |
| 3,011,485 | 12/1961 | Van Slooten | 123/90.55 |
| 3,448,730 | 6/1969 | Abell | 123/90.35 |
| 3,636,932 | 1/1972 | Hamilton | 123/90.55 |

*Primary Examiner*—Charles J. Myhre
*Assistant Examiner*—Jeffrey L. Yates
*Attorney, Agent, or Firm*—R. J. McCloskey; R. A. Johnston; E. C. Crist

[57] ABSTRACT

A hydraulic lash adjuster for valve gear of an internal combustion engine, the lash adjuster being of the type which operates from oil received under pressure from a gallery provided in the engine lubricant supply system. The body of the adjuster has a movable plunger with a one-way check valve for admitting and retaining oil in a chamber between the adjuster body and the plunger. A portion of the plunger includes a pivot surface for pivotally engaging associated components of the valve gear with a reservoir formed in the plunger which communicates with a one-way valve for admitting oil to the chamber. An inlet metering means including an annular metering land provides exclusive lubricant communication to the reservoir from an oil entry port in the body.

24 Claims, 5 Drawing Figures

LASH ADJUSTMENT MEANS FOR VALVE GEAR OF AN INTERNAL COMBUSTION ENGINE

BACKGROUND OF THE INVENTION

This is a continuation, of application Ser. No. 779,219, filed Mar. 18, 1977, now abandoned, which is a continuation of application Ser. No. 606,632 filed Aug. 21, 1975 now abandoned, which application is a continuation-in-part of my copending application Ser. No. 550,785 filed Feb. 18, 1975, now abandoned.

In relatively small displacement multicylinder internal combustion engines of the type having overhead valve gear, for example, four-cylinder in-line engines, it is not uncommon for such engines to operate at high rotational speeds, for example, 4000–6000 r.p.m. during a large percentage of the normal duty cycle. In this high r.p.m. regime, the intertial forces of the valve gear can become critical with respect to the valve spring closing force. In order to reduce the inertial forces of the valve gear, it is desirable to eliminate the pushrod type valve gear and utilize a direct acting or cam-over-rocker arrangement. This arrangement eliminates the tappets and pushrods between the camshaft and the valve rocker arms. However, in designing valve gear for a cam-over-rocker arrangement where the cam lobes contact the rocker arms directly, the usual technique, employed in pushrod-type valve gear of providing lash adjustment in the tappet, is not available. Whereas, in the conventional pushrodtype valve gear, the lash adjustment is usually provided in the form of a combination tappet-hydraulic valve lifter between the pushrod and the camshaft. Where attempts have been made to utilize hydraulic lash adjusters for cam-over-rocker valve gear, it has been found that the most compact arrangement is to provide the lash adjustment at a stationary pivot about which one end of the valve rocker is pivoted. However, where the lash adjusters operate from the pressurized engine oil, the force obtained from the oil pressure acting on the end of the adjuster plunger is increased by the mechanical leverage of the rocker and applied to the cam lobe at the rocker contact surface. This additional force results in the need for greater valve spring forces at high r.p.m.

Furthermore it has been found that, upon starting of cold engines having valve gear with hydraulic lash adjusters supplied by the engine lubricant system, at high r.p.m. while the engine is cold, extremely high oil pressure conditions are experienced. For example, it has been determined that high r.p.m. operation of a cold engine has produced engine lubricant system pressures in the range of 85 to 130 p.s.i.; whereas, ordinary engine operating conditions produce only a maximum lubricant pressure of 65 p.s.i. at maximum r.p.m.

In engines of the type having cam-over-rocker valve gear and employing stationary hydraulic lash adjusters supplied from the engine lubricant system, this high oil pressure, in the range of 85 to 130 p.s.i. acting across the surface of the lash adjuster plunger, provides a sufficient axial force on the plunger to pivot the rocker arm about a fulcrum, located at the point of contact of the rocker arm with the cam lobe, and to overcome the closing force of the engine poppet valve spring. Thus, a situation occurs where, at high r.p.m. with a cold engine, the hydraulic lash adjusters hold the engine valves open, and this condition is sometimes referred to as pump-up. This condition will generally persist until the engine reaches normal operating temperature where the oil pressure decreases to the normal operating range. This decrease in oil pressure decreases the force of the lash adjuster plunger on the rocker arm and permits the valve springs to properly close the valves during each cam event.

SUMMARY OF THE INVENTION

The present invention provides a solution to the above described problem by providing a hydraulic lash adjuster for stationary use in engines having cam-over-rocker type valve gear and permits the hydraulic lash adjuster to be supplied with lubricant from the engine supply system, but reduces the force of the engine lubricant pressure acting over the surface of the lash adjuster plunger and thus eliminates "pump-up" during high r.p.m. cold engine operation. The valve gear of the present invention includes a hydraulic lash adjuster having a one-way valve in the plunger for admitting oil to the cavity between the plunger and the lash adjuster body and has a reservoir in the plunger communicating with the one-way valve. The lash adjuster of the present valve gear includes a lubricant entry port in the body for receiving lubricant from the engine supply system. A primary fluid metering passage is provided in the lash adjuster for providing exclusive communication of the lubricant from the entry port to the plunger reservoir and includes primary fluid metering means for metering all the lubricant flowing to the plunger reservoir. The primary metering means of the lash adjuster of the present invention includes an annular metering land provided between the cooperating surfaces of the plunger and the bore in the lash adjuster body. A pressure relief means communicates with the fluid metering passage between the primary metering means and the reservoir for limiting the pressure buildup in the reservoir. The pressure relief means includes a second metering means.

The present invention thus provides a solution to the above-described problem by venting to the atmosphere the oil reservoir in the lash adjuster plunger through a secondary metering means such that there is only negligible effective oil pressure acting on the bottom of the plunger to apply a force to the rocker arm. The lash adjuster in the valve gear of the present invention receives oil from the engine lubricant supply and meters all of the lubricant flow to the plunger reservoir to provide lower pressure in the reservoir to prevent "pump-up" yet prevents undesirable loss of pressure in the engine supply.

DETAILED DESCRIPTION

Figure 1:
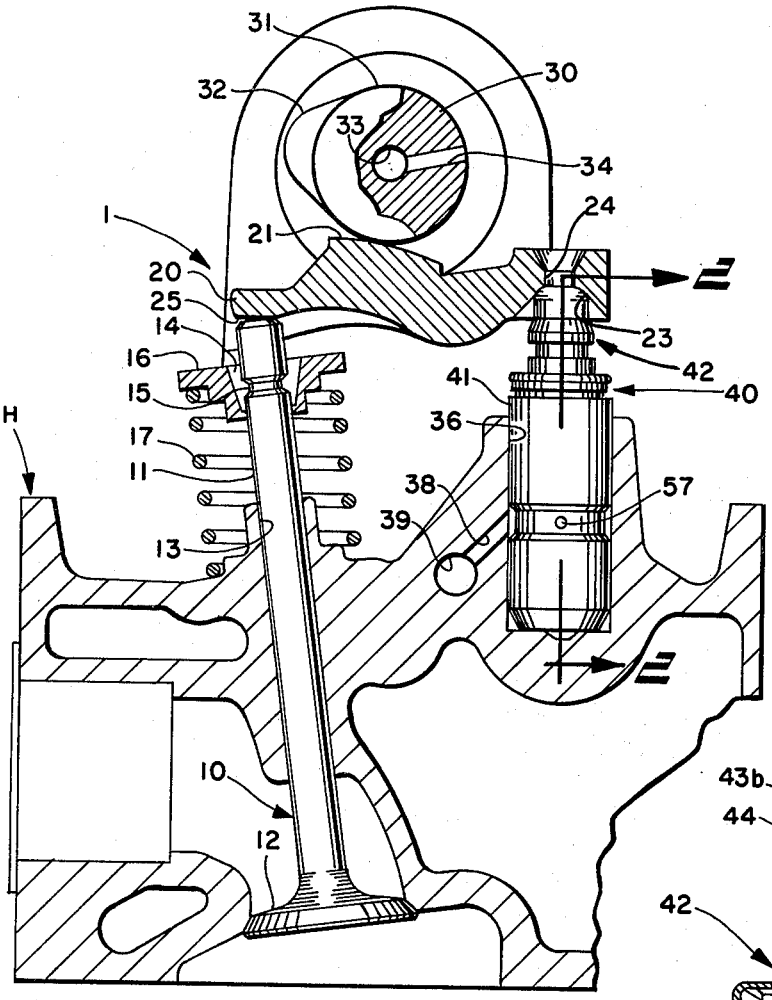
FIG. 1 is a transverse cross section through the cylinder head and camshaft of an overhead valve cam-over-rocker engine employing the lash adjuster of the present invention.

Referring now to FIG. 1, the cylinder head H of an engine is shown in cross section with valve gear 1 of the type having a cam-over-rocker configuration for a single valve for communicating with the combustion chamber. The valve gear includes a poppet valve 10 having a stem portion 11 and a head portion 12 with the stem received in a valve guide 13 provided in the engine cylinder head H. The stem of the valve has a groove 15 formed therein in which is engaged a peripherally split keeper 14 for retaining thereon a spring washer 16 which provides a register for the valve compression spring 17.

An overhead rocker arm 20 is provided with a cam follower pad 21 provided on one side intermediate the ends thereof and has a contact pad 25 provided on one end of the side opposite the cam follower, for contacting the end of the valve stem. The opposite end of the rocker arm has a pivot recess 23 formed therein on the same side of the rocker arm as the valve stem pad 25 with a vent means, preferably in the form of an aperture 24, or oil hole, provided therethrough to communicate with a recess 23 from the opposite, or cam follower side of the rocker.

The end of the rocker arm having the pivot recess 23 formed therein is pivotally connected to a stationary pivot means in the form of a hydraulic lash adjuster 40. The engine camshaft 30 is disposed over the rocker and is mounted in bearings (not shown) attached to the engine cylinder head H in the usual manner. The camshaft has a plurality of lobes 32 each having a base circle portion 31 and the camshaft has a central oil gallery 33 in the form of a longitudinal bore therethrough. Each cam lobe has a radial oil port 34 communicating with the oil gallery 33 and extending radially outwardly to communicate with the base circle portion 31 of the cam lobe.

In operation, as the camshaft rotates, engine oil under pressure is supplied to the gallery 33 by a suitable rotary connection (not shown) communicating with the engine oil pump circuit. The oil is discharged radially outwardly from the oil ports 34 for providing lubrication of the cam lobe as it contacts the pad 21 of the rocker arm.

It will be readily apparent that, during the majority of each revolution of the camshaft, the oil discharged from the radial port 34 is discharged freely outwardly into the space surrounding the camshaft. It will thus be apparent to those skilled in the art that a suitable cover housing (not shown) will be required to retain the free discharged oil and return the oil to the engine sump.

Referring again to FIG. 1, a suitable blind bore 36 is provided in the engine cylinder head H for receiving therein the lash adjuster 40. The bore 36 has communicating therewith a suitable oil port 38 which port also communicates with an oil gallery 39 provided in the cylinder head of the engine. The oil gallery 39 is connected by suitable passages (not shown) to the engine oil pressure supply system and thus supplies engine oil under pressure to the hydraulic lash adjuster 40.

Figure 2:
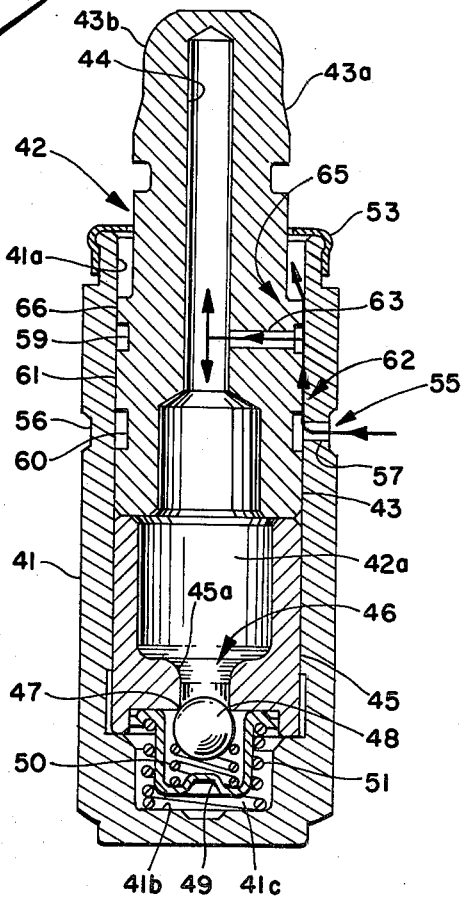
FIG. 2 is a section view taken along section indicating lines 2—2 of FIG. 1 and shows details of the stationary hydraulic lash adjuster.

Referring now to FIG. 2, the stationary lash adjuster 40 is shown as having a body 41 preferably of cylindrical configuration with a bore **41*a* having a blind end 41*b* formed therein and with a plunger means 42 slidably received in the bore in close fitting relationship. The plunger is shown in the preferred form as formed of two pieces, an upper section 43 and a lower section 45, but it will be understood that the plunger means 42 may be made of one piece, if desired. The plunger is preferably made in two sections to permit enlargement of an oil passage therethrough in the region intermediate the ends of the plunger to form a fluid reservoir 42*a*. The upper section 43 of the plunger has an exterior portion 43*a* extending outwardly from the body 41 with the end of the plunger having a rounded tip 43*b*, preferably of spherical radius provided thereon for pivotally engaging the recess 23 in the rocker arm. The remainder of the upper section 43 is slidably received in the bore 41*a* in a closely fitting relationship. The upper portion of reservoir 44 may, if desired, have a greater transverse dimension in the portion of the section 43 received in the bore, than the transverse dimension of the portion 44 in the exterior portion 43*a* in order to provide greater capacity to reservoir 42*a***.

The lower section 45 abuts the upper section 43. The lower section of the plunger 45 has a passage **45*a* provided therein which extends longitudinally therethrough. The passage 45*a*, if desired, may be enlarged in the region of abutment to provide additional capacity to oil reservoir 42*a*. The end of the lower section 45 of the plunger means 42 forms, in cooperation with the end 41*b* of the blind bore 41*a*, a chamber 41*c* for retaining oil to maintain the plunger position for lash adjustment. A check valve 46 is provided in the end of the passage 45*a* of the lower section 45 of the plunger means so as to permit one-way flow of oil from the passage 45*a* through the end of the lower section 45 to the chamber 41*b*. The passages 44 and 45*a*** each preferably have a minimum transverse dimension equal to approximately one-third the transverse dimension of the plunger.

The check valve 46 preferably has a valve seat 47 formed at the juncture of the passage **45*a* with the end of the lower section 45 of the plunger means and the valve 46 has a movable member 48, preferably a check ball received therein. The member 48 is movable from a closed position contacting the valve seat 47 to an open position spaced from the valve seat 47. A cage 49 is received over the check ball and serves to retain the ball therein. A bias spring 50 is provided within the case to urge the check ball 48 to a closed position in contact with the valve seat 47. A plunger bias spring 51 is provided in the chamber 41*c* to register against the end of the lower portion 45 of the plunger means to urge the plunger in a direction away from the blind end 41*b* of a bore 41*a*. An annular plunger retainer 53 is provided over the upper end of the body 41 with the exterior portion 43*a* of the upper plunger section 43 received therethrough, and the retainer 53 serves to retain the plunger means in the body against the bias force of spring 51**, when no load is present on the plunger means.

An oil entry port means 55 is provided on the exterior of the body 41. The port means includes a collector groove 56 and an oil entry aperture 57 communicating the collector groove 56 with the bore **41*a* in the body 41**.

The plunger means 42 has a pair of axially spaced grooves 59 and 60 disposed about the outer diameter thereof. The grooves 59 and 60 thus define, in cooperation with the bore **41*a*, a primary metering means 62 which includes an axial section of the outer diameter of the plunger means 42 which section forms a metering land 61. It will be apparent to those skilled in the art that collector grooves 59 and 60 are so located on the plunger means 42 such that, during the movement of the plunger means between its predetermined limits of lash adjustment the lower collector groove 60 will, at all times, receive oil from the entry port 55. The upper collector groove 59 has a passage means in the form of a cross hole 63 provided therein which cross hole communicates the upper collector groove 59 with the interior passage 44 in the plunger means. Thus, oil entering the port means 55 passes through the primary metering means 62, along the metering land 61 to the upper collector groove 59, then through cross hole 63 to the oil reservoir in the interior bore 44, 45***a* forming the reservoir 42*a* in the plunger means. The path of the metered oil is shown in FIG. 2 by the heavy black line with arrow heads indicating the direction of metered flow.

The axial arrangement of the oil entry hole 57 in the body bore and the cooperating collector grooves 59 and 60 in the plunger means as shown in the embodiment of FIG. 2 provides a metering land having a preferable constant length not dependent upon the position of the plunger means 42 in the bore 41*a* of the adjuster body. This arrangement thus provides a constant length metering land as is known in the art, see, for example, U.S. Pat. No. 3,448,730 to Roy F. Abell, Jr. In the present practice of the invention plunger movements in the amount of 0.150 to 0.200 inches are permitted for lash adjustment and for which movement the metering land is maintained constant.

It will be apparent to those having ordinary skill in the art, that the adjacent abutting surfaces of the upper plunger section 43 and lower plunger section 45 must be designed so as to effectively provide a seal and prevent leakage of oil therethrough, thereby preventing an alternate by-pass, or shunt, flow of lubricant other than through the primary metering means 62.

In order to provide sufficient lubricant fluid flow across the check valve at high r.p.m. and to prevent consequent malfunction of the lash adjustment, it has been found necessary to maintain the fluid pressure reservoir 42*a* at pressures above atmospheric but less than the engine supply pressure in gallery 39 (FIG. 1). The present invention provides this pressure control by an atmospheric pressure relief means 65 having a second metering means in communication with the primary fluid passage 63. The secondary pressure-relief metering means preferably includes a second metering land 66 disposed above the upper collector groove 59. The presently preferred lash adjusting means 40 of the valve gear thus employs a primary metering means 62 and secondary pressure relief metering means 65 fluidically in parallel with the fluid reservoir 42*a*. For proper control of the pressure in reservoir 42*a*, the primary and secondary metering means are chosen such that the pressure drop $\Delta P_{62}$ across the primary metering means 62 is greater than the pressure drop $\Delta P_{65}$ across the pressure relief secondary metering means 65. In the present practice of the invention it has been found for cold oil starts with oil entering port means 55 at 100 p.s.i. (34.4 Kg/cm$^2$) and using a primary metering land of 0.200 inches (5.08 mm) length with about 0.0021 in. (0.050 mm) clearance for a 0.60 in. (15.2 mm) diameter plunger and a secondary metering land of half the length of the primary metering land but with the same clearance gives a pressure of 31 p.s.i. (10.6 Kg/cm$^2$) in reservoir 42*a* and for an entry pressure of 80 p.s.i. (27.5 Kg/cm$^2$) gives a reservoir pressure of 27 p.s.i. (9.3 Kg/cm$^2$). The significance of the present invention will be even more appreciated at higher oil entry port pressures, where measurements have shown that for 150 p.s.i. (51.6 Kg/cm$^2$) pressure in entry port 55 the pressure in the reservoir did not exceed 45 p.s.i. (15.4 Kg/cm$^2$), whereas a corresponding lash adjuster without the primary metering means 62 and secondary pressure relief means 65 maintained a reservoir pressure of 110 p.s.i. (37.8 Kg/cm$^2$) for the same entry pressure. Preferably, the length of secondary metering land 66 is chosen so as to maintain the reservoir pressure at less than one-third of the oil entry pressure at port 55. As described above, in the present practice this was accomplished satisfactorily with a secondary pressure relief metering land 66 having an axial length, for the same diameter and clearance, of half the length of primary metering land 61. It will also be apparent that the surface of the bore 41*a*, cooperating with secondary pressure-relief metering land 66, should preferably be uninterrupted for a sufficient length to provide a constant length annular metering land for the desired range of plunger movement for lash adjustment.

Although the lash adjustment means of the present invention has been described as employed in a stationary lash adjuster for the cam-over-rocker type valve gear, it will be appreciated that the lash adjustment means may be employed also in a cam-following hydraulic tappet for use with the conventional cam-in-block type valve gear having pushrods. In this latter type of valve gear, a hydraulic tappet using the present lash adjustment means could readily be formed by simply shortening the upper plunger member 43 so as to not extend beyond the body 41, removing the rounded tip 43*b* and replacing same with a concave pushrod socket for receiving a pushrod. The primary metering means 62 and the secondary pressure relief metering means 65 would be retained and would function in the same manner as in the herein described lash adjuster.

Figure 3:
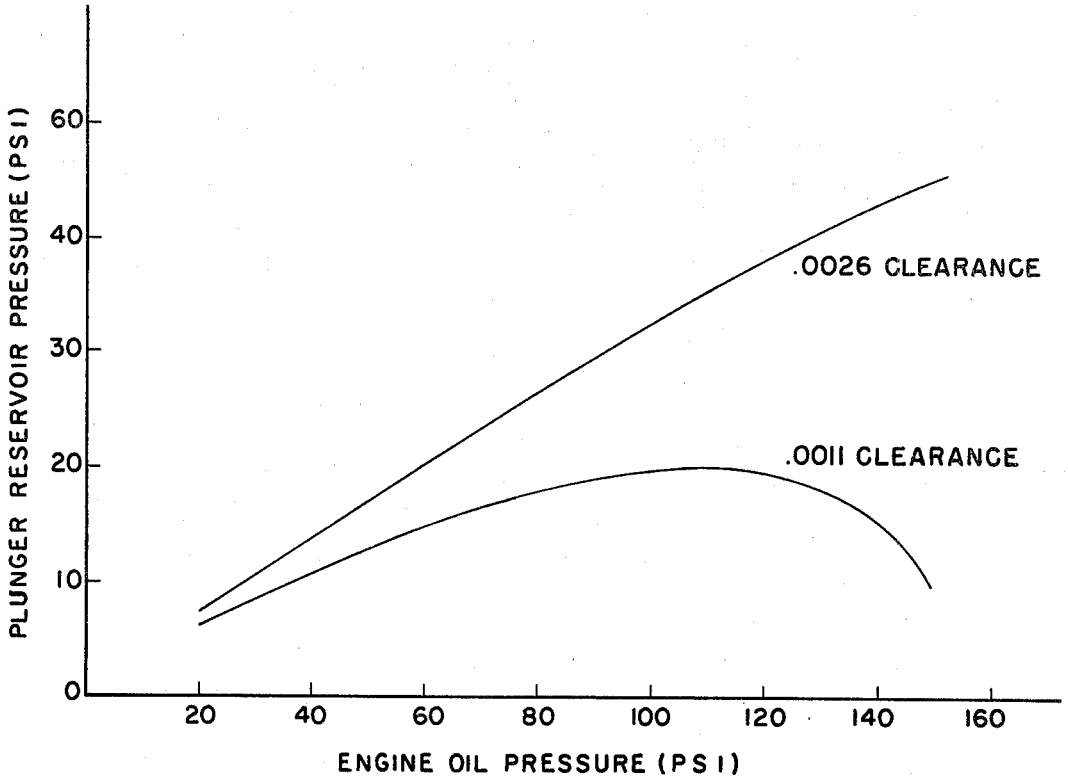
FIG. 3 is a graph of plunger reservoir pressure vs. entry port pressure for differing plunger to bore diametrical clearances.

It will be apparent from FIG. 3 that the plunger-to-body diametral clearance less than 0.0011 produces non-lineal metering through the primary metering land. In the presently preferred practice a diametral clearance of 0.0021 has been found particularly suitable. However, clearance having values between the curves of FIG. 3 will operate satisfactorily.

In operation, as the base circle portion of the cam rotates to a position in contact with the path 21 on the rocker arm, the spring 51 urges the plunger sections 43 and 45 away from the bore end 41*b* so that the rounded tip 43 moves the rocker to contact and urge the recess 23 in the rocker arm upward until the pad 21 is forced to contact a base circle portion of the cam. As the cam lobe 32 contacts the pad 21 of the rocker arm and asserts a force on the pivoted end of the rocker arm, both of the plunger sections 43, 45 are forced downward together as a unit in a manner tending to compress the oil trapped in chamber 41*c*. The check valve 46 prevents unwanted flow of oil from the chamber 41*c* and thus prevents further downward movement of the plunger sections, shortening of the adjuster and thus prevents further movement of the rocker pivot.

Figure 4:
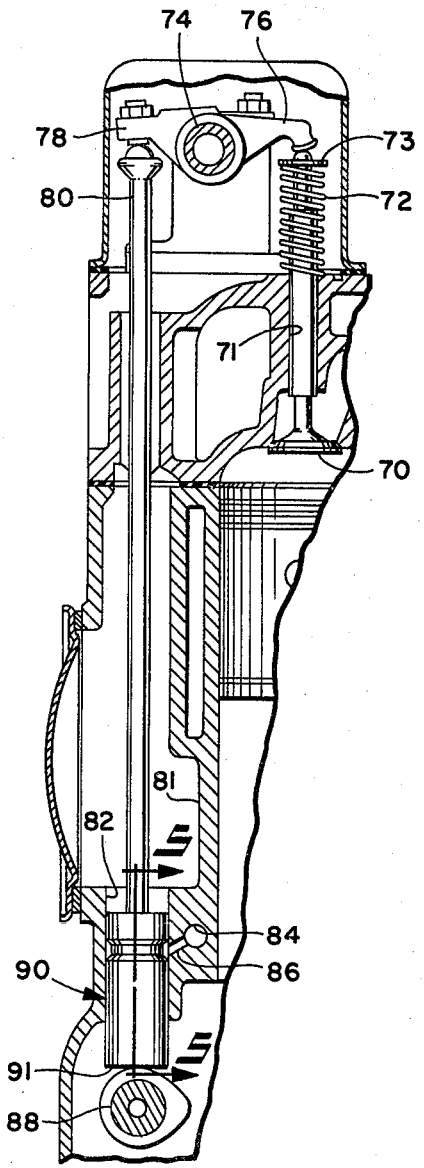
FIG. 4 is a transverse cross section through the block of an engine having overhead valve gear employing cam-in-block and tappets and pushrods intermediate the cam and valve rockers.
Figure 5:
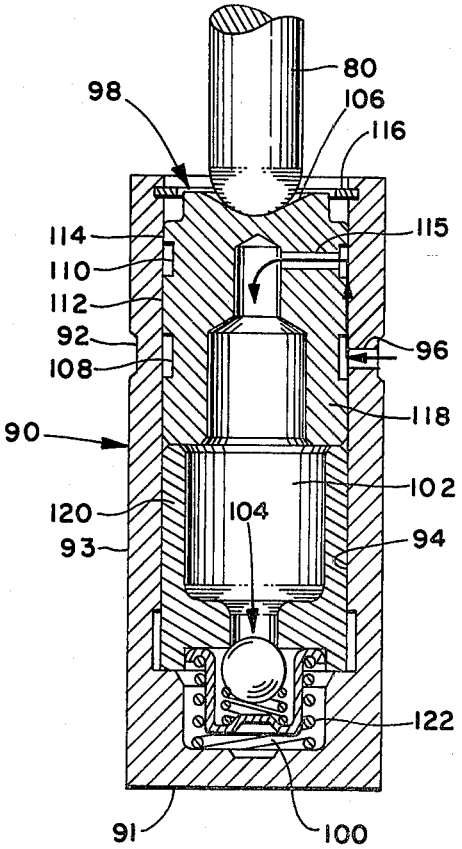
FIG. 5 is a partial section view taken along section indicating lines 5—5 of FIG. 4 and shows the details of the tappet with the hydraulic lash adjuster.

As mentioned hereinabove the hydraulic lash adjuster of the present invention may be employed in a cam-following tappet for conventional pushrod type valve gear. Such an embodiment is illustrated in FIGS. 4 and 5, where an internal combustion engine has an overhead valve gear with a valve 70 having the stem thereof received in a valve guide 71 formed in the cylinder head of the engine. A valve closing means as, for example, spring 72 is received over the valve stem with a keeper 73 attached thereon to retain the spring, thus causing the spring 72 to bias the valve in the closed position. A rocker shaft 74 is provided in the engine head and individual rocker arms 76 pivoted thereabout so as to each have one end thereof contacting the end of the valve stem. The opposite end 78 of each rocker arm is in pivotal contact with a pushrod 80 which extends downwardly through a passage in the cylinder head in a manner such that the pushrod is free to reciprocate in the cylinder head. A tappet guide bore 82 is provided in the engine block 81 and the guide bore 82 has a passage 86 communicating therewith, which passage also communicates with a gallery 84 in the pressurized engine oil pump circuit. The tappet 90 is received slidably in the bore 82 with the end face 91 thereof in contact with a cam surface of the rotating camshaft 88. The cam surface of the shaft 88 has the conventional base circle portion and radially extending lobe portion for causing longitudinal movement of the tappet within the bore 82 during each revolution of the camshaft.

The tappet 90 has a collector groove 92 provided around the periphery thereof for registering with the oil passage 86 as the tappet moves in the bore 82 for receiving a supply of pressurized oil from the engine pump circuit to operate the hydraulic lash adjusting means within the tappet 90. Referring now to FIG. 5, the tappet 90 is shown in enlarged cross-section as having a body 93 having a blind bore 94 formed therein with the blind end of the bore terminating adjacent the cam face 91 of the tappet. Inlet port means are provided in the form of a hole 96 in the wall of the body 93 communicating the collector groove 92 with the bore 94 for transmitting pressurized engine lubricant to the hydraulic lash adjusting means contained therein.

The tappet bore 94 has a plunger means 98 slidably received therein, which plunger means forms, in cooperation with the end of the blind bore, a cavity 100 for retaining oil therein. The plunger means has a reservoir 102 provided therein and further has one-way valve means 104 communicating the reservoir with the cavity 100. The valve means 104 permits fluid flow from the reservoir into the cavity, but prevents flow in the reverse direction. The end of the plunger means opposite the valve means 104 has a pivot surface in the form of socket 106 provided therein, which socket is adapted to pivotally contact associated components of the valve gear such as the rounded end of pushrod 80 as shown in FIG. 4. A spring 108 biases the plunger means in a direction outwardly of said cavity 100. A plurality of spaced grooves 108, 110 are provided on the plunger means 98, which grooves form the primary and secondary annular metering lands 112, 114, respectively. Passage means is provided for exclusively communicating the flow of oil from the inlet port 96 to the reservoir 102, which passage means is formed by the primary annular metering land 112 cooperating with bore 94 and cross hole 115 which communicates with the reservoir 102 and the upper metering land groove 110. Thus, as lubricant under pressure enters inlet port 96, all lubricant flow is metered across the primary metering land 112 for passage into the reservoir 102. As pressure in the reservoir increases, pressure relief means in the form of secondary metering land 114, permits the cross hole and reservoir 102 to be vented to the atmosphere after a second pressure drop across the secondary metering land 114. Thus the primary and secondary metering lands 112, 114 are fluidically in series with each other. It will be noted, however, that the cross hole 115 and pressure relief means 114 are fluidically in parallel with the primary metering land 112. The path of the oil flow is indicated in FIG. 5 by the solid black arrows. In the embodiment of FIGS. 4 and 5, the presure relief means 114 prevents pressure build-up within the reservoir 102, yet maintains the reservoir at the desired super-atmospheric pressure in the same manner as discussed above with regard to the embodiments of FIGS. 1, 2 and 3. A retaining means in the form of snap ring 116 is provided to retain the pluner within the bore 94.

In the presently preferred practice of the invention, the plunger means 98 is formed of an upper portion 118 and a lower portion 120 which portions are in abutting contact along their respective adjacent transverse faces for preventing oil leakage in a manner similar to that described hereinabove with regard to FIGS. 1–3. Reservoir 102 is preferably formed partially in the upper member 118 and the lower member 120, with the upper member having cross hole 115 and metering land grooves 110 and 108 formed therein; whereas, the lower member 120 has valve means 104 formed therein for communicating lubricant to the cavity 100.

In operation, as the camshaft 88 of FIG. 4 rotates, the lobe of the cam surface causes the tappet 92 to move upwardly within bore 82 so as to exert a force on the pushrod 80. The upward movement of pushrod 80 rotates rocker 76 in a clockwise manner about the shaft 74 to press down upon the stem of valve 70 and thus opens the valve. When the lobe portion of the cam surface begins to raise the tappet 90, the valve means 104 closes and traps oil in cavity 100 which prevents the plunger means 98 from further collapsing within the bore 94. When the lobed surface portion of the cam surfaces passes the tappet, the tappet face 91 rests on the base circle portion of the cam and the valve closes. When the valve is closed and the tappet face contacts the base circle of the cam, the force on pushrod 80 then decreases to a level as determined by the plunger return spring 122 provided in the cavity of the tappet body. The plunger return spring 122 moves the plunger upwardly within the tappet body, thereby causing the plunger to take up any lash in the pushrod-rocker-valve train; and, simultaneously oil is admitted into the cavity 100 through the valve means by the suction formed in the cavity due to the outward motion of the plunger means therefrom. As the cam lobe surface continues rotation for a subsequent valve event, and the lobe pushes the tappet upward, the pushrod exerts a force on the tappet plunger 98 and causes valve means 104 to close, retaining the plunger in its adjusted position by trapping therein the lubricant which entered into cavity 100 during the time when the valve means 104 was open.

The hydraulic lash adjuster of the present invention thus provides a novel and convenient technique for providing hydraulic lash adjustment to over-head valve gear of the cam-over-rocker type as a stationary lash adjuster or as a hydraulic tappet for cam-in-block and pushrod type overhead valve gear. The hydraulic lash adjuster of the present invention receives oil from an engine oil pressure gallery and all oil flow to the lash adjuster reservoir is metered through a primary annular metering land disposed in the reservoir entry passage. Oil is vented from the reservoir through a secondary pressure relief metering means which communicates with the entry passage and maintains the reservoir pressure at a level above atmospheric pressure, but less than the entry pressure, to provide adequate fluid flow across the check valve for lash adjustment at high engine speeds. The pressure relief metering means thus prevents undesired pressure build-up in the tappet reservoir during periods when engine oil pressure is abnormally high.

Further modifications and variations will be apparent to those having ordinary skill in the art and the invention is limited only by the following claims.

What is claimed is:

1. Hydraulic lash adjusting means for valve gear of an internal combustion engine comprising:
   (a) a body having a blind bore formed therein;
   (b) plunger means slidably received in said body bore and defining, in cooperation with the blind end of said bore, a cavity, said plunger means including,
      (i) means defining a pivot surface adapted to contact associated engine valve gear components,
      (ii) means defining a fluid reservoir, and
      (iii) one-way valve means permitting fluid flow from said reservoir to said cavity;
   (c) said body including inlet port means communicating with said bore and adapted for receiving fluid under pressure therein;
   (d) means defining a fluid passage communicating with said port means and exclusively providing fluid communication therefrom with said reservoir, said passage defining means including primary fluid metering means continuously metering all fluid to said reservoir, said primary metering means including a first annular collector groove and a first annular metering land fluidically downstream of said collector groove;
   (e) pressure relief means communicating with said fluid passage, said pressure relief means including secondary metering means including a second annular collector groove and a second annular metering land downstream of said second collector groove for metering fluid flow from said passage to the atmosphere wherein said first metering land is intermediate said first and second collector groove; and,
   (f) means biasing said plunger means outwardly of said cavity.

2. The lash adjusting means defined in claim 1, wherein said primary metering means and said pressure relief means each include means defining an annular metering land.

3. The lash adjusting means defined in claim 1, wherein for any given fluid entry pressure and viscosity at said port means, said primary and secondary metering lands are formed such that the pressure drop across said primary metering means is greater than the pressure drop across said secondary metering means.

4. The lash adjusting means defined in claim 1, wherein said plunger means includes,
   (a) an upper plunger member having portions thereof defining said pivot surface, said upper member having other portions thereof defining said fluid passage; and
   (b) a lower plunger member including said one-way valve means, with said lower plunger member having portions thereof defining at least a part of said fluid reservoir.

5. The lash adjusting means defined in claim 4, wherein said plunger member has portions thereof defining at least part of said reservoir.

6. The lash adjusting means defined in claim 4, wherein said primary and secondary metering means includes respectively a separate portion of said upper plunger member, each defining annular metering land.

7. The lash adjuster defined in claim 1, wherein said pressure relief means, said primary metering means and said port means are fluidically in series.

8. The lash adjuster defined in claim 1, wherein said pressure relief means and said reservoir are fluidically in parallel with said primary metering means.

9. The lash adjusting means defined in claim 1, wherein said body has a cam-following face formed thereon adjacent the closed end of said bore for contacting the lobes of the engine camshaft and has the exterior thereof formed to a surface for sliding contact with an engine tappet guide.

10. The lash adjusting means defined in claim 9, wherein said plunger means includes,
   (a) an upper plunger member having portions thereof defining said pivot surface, said upper member having other portions thereof defining said fluid passage; and,
   (b) a lower plunger member including said one-way valve means.

11. The lash adjusting means defined in claim 10, wherein said lower plunger member has portions thereof defining at least a part of said fluid reservoir.

12. The lash adjusting means defined in claim 10, wherein said upper plunger member has portions thereof defining at least a part of said fluid reservoir.

13. Hydraulic lash adjusting means for valve gear of an internal combustion engine comprising:
   (a) a body having a blind bore formed therein;
   (b) plunger means slidably received in said body bore and defining, in cooperation with the blind end of said bore, a cavity, said plunger means including,
      (i) means defining a surface adapted to contact associated engine valve gear components,
      (ii) means defining a fluid reservoir, and
      (iii) one-way valve means permitting fluid flow from said reservoir to said cavity;
   (c) said body including inlet port means communicating with said bore and adapted for receiving fluid under pressure therein;
   (d) means defining a fluid passage communicating with said port means and exclusively providing fluid communication therefrom with said reservoir, said passage defining means including primary fluid metering means continuously metering all fluid to said reservoir, said primary metering means including a first annular collector groove and a first annular metering land fluidically downstream of said collector groove;
   (e) pressure relief means communicating with said fluid passage, said pressure relief means including secondary metering means including a second annular collector groove and a second annular metering land downstream of said second collector groove for metering fluid flow from said passage to the atmosphere wherein said first metering land is intermediate said first and second collector groove; and,
   (f) means biasing said plunger means outwardly of said cavity.

14. The lash adjusting means defined in claim 13, wherein said primary metering means and said pressure relief means each include means defining an annular metering land.

15. The lash adjusting means defined in claim 13, wherein for any given fluid entry pressure and viscosity at said port means, said primary and secondary metering lands are formed such that the pressure drop across said primary metering means is greater than the pressure drop across said secondary metering means.

16. The lash adjusting means defined in claim 13, wherein said plunger means includes, (a) an upper plunger member having portions thereof defining said fluid passage; and (b) a lower plunger member including said one-way valve means, with said lower plunger member having portions thereof defining at least a part of said fluid reservoir.

17. The lash adjusting means as defined in claim 16, wherein said upper plunger member has portions thereof defining at least part of said reservoir.

18. The lash adjusting means defined in claim 16, wherein said primary and secondary metering means includes respectively a separate portion of said upper plunger member, each defining annular metering land.

19. The lash adjusting means defined in claim 13, wherein said pressure relief means, said primary metering means and said port means are fluidically in series.

20. The lash adjusting defined in claim 13, wherein said pressure relief means and said reservoir are fluidically in parallel with said primary metering means.

21. The lash adjusting means defined in claim 13, wherein said body has a cam-following face formed thereon adjacent the closed end of said bore for contacting the lobes of the engine camshaft and has the exterior thereof formed to a surface for sliding contact with an engine tappet guide.

22. The lash adjusting means defined in claim 21, wherein said plunger means includes, (a) an upper plunger member having portions thereof defining said fluid passage; and, (b) a lower plunger member including said one-way valve means.

23. The lash adjusting means defined in claim 22, wherein said lower plunger member has portions thereof defining at least a part of said fluid reservoir.

24. The lash adjusting means defined in claim 22, wherein said upper plunger member has portions thereof defining at least a part of said fluid reservoir.

* * * * *